United States Patent [19]

Wegmann et al.

[11] 4,240,328

[45] Dec. 23, 1980

[54] VALVE MECHANISM FOR A HYDRAULIC EXPANSIBLE CHAMBER MOTOR

[75] Inventors: Jerome B. Wegmann, St. Louis County; Jeffrey M. Kotyk, St. Louis, both of Mo.

[73] Assignee: McNeil Corporation, Akron, Ohio

[21] Appl. No.: 21,592

[22] Filed: Mar. 19, 1979

[51] Int. Cl.[3] ..... F01L 25/06; F01L 23/00

[52] U.S. Cl. ..... 91/287; 91/313; 91/314; 91/342

[58] Field of Search ..... 91/287, 313, 314, 342

[56] References Cited

U.S. PATENT DOCUMENTS

| | | | |
|---|---|---|---|
| 12,203 | 1/1855 | Hubbard et al. | 91/287 |
| 263,785 | 9/1882 | Hubbard | 91/287 |
| 334,108 | 1/1886 | Cary | 91/287 |
| 2,750,932 | 6/1956 | Klein | 91/287 |
| 2,944,528 | 7/1959 | Phinney | 91/55 |

*Primary Examiner*—Paul E. Maslousky

*Attorney, Agent, or Firm*—Senniger, Powers, Leavitt and Roedel

[57] ABSTRACT

A hydraulic valve mechanism for a hydraulic motor having a cylinder and a piston reciprocating therein, comprising a valve block having a valve face, a main and an auxiliary central exhaust ports, two main feed ports on opposite sides of the main exhaust port, and two auxiliary feed ports on opposite sides of the auxiliary exhaust port. A valve chest is sealed over the valve face and has aligned piston-receiving bores at its opposite ends, a chamber for pressurized hydraulic fluid between the bores and a valve-actuating piston slideable in the bores. A main D-valve and an auxiliary D-valve operable by the valve-actuating piston move within the chamber in sliding sealing engagement with the valve face. The main D-valve covers and uncovers the main exhaust port and main feed ports to control the reciprocation of the motor piston. The auxiliary D-valve covers and uncovers the auxiliary exhaust port and auxiliary feed ports which communicate with closed ends of the bores to control the position of the valve-actuating piston and the main D-valve. The auxiliary D-valve is so formed in relation to the auxiliary feed ports that it does not completely block hydraulic fluid flow through either one of the auxiliary feed ports at any position along its line of motion, thereby preventing hydraulic lock.

5 Claims, 7 Drawing Figures

VALVE MECHANISM FOR A HYDRAULIC EXPANSIBLE CHAMBER MOTOR

BACKGROUND OF THE INVENTION

This invention relates to a valve mechanism for a hydraulic expansible chamber motor, and more particularly to a quick-acting valve mechanism for actuating the distributing valve of such a motor.

The invention involves an improvement upon the quick-acting valve mechanism of the type such as shown in U.S. Pat. No. 2,750,932 for a motor having a cylinder and a piston reciprocating therein, comprising a main D-valve sliding on a valve face for controlling the supply of fluid to and the exhaust of fluid from the opposite ends of the cylinder so as to reciprocate the piston and an auxiliary D-valve sliding on the valve face responsive to the approach of the piston to either end of the cylinder for controlling the operation of the main D-valve. Air is the working fluid in the distributing valve and motor of this type and a problem encountered in the operation of the valve and motor is the generation of noise as compressed air flows through the D-valves into the cylinder and expands upon being exhausted from the cylinder. Another problem is the relatively high initial and operating cost of the required ancilliary equipment such as the air compressor and prime mover.

SUMMARY OF THE INVENTION

Among the several objects of this invention may be noted the provision of a quick-acting hydraulic valve mechanism for a hydraulic expansible chamber motor adapted for quiet and economical operation, as distinguished from an air motor with an air-operated quick-acting valve mechanism.

Briefly, the apparatus of this invention involves a hydraulic valve mechanism for an expansible chamber hydraulic motor. The motor comprises a cylinder and a piston reciprocating therein with a piston rod extending beyond an end of the cylinder. The valve mechanism comprises a block with a valve face at one side of the cylinder having therein a main central exhaust port and an auxiliary central exhaust port, two main feed ports on opposite sides of the main central exhaust port, and two auxiliary feed ports on opposite sides of the auxiliary central exhaust port. A valve chest is secured in sealed relation to the block. The valve chest has aligned piston-receiving bores at its opposite ends, a chamber for hydraulic fluid under pressure between the bores and a valve-actuating piston slideable in the bores. A main D-valve and an auxiliary D-valve move within the chamber and are in sliding sealing engagement with the valve face. The main D-valve covers and uncovers the main exhaust port and feed ports so that alternately one main feed port communicates with the main exhaust port while the other main feed port communicates with the chamber to control the reciprocation of the motor piston. The auxiliary D-valve covers and uncovers the auxiliary exhaust port and auxiliary feed ports which communicate by passages with closed ends of the bores to control the position of the valve-actuating piston and the main D-valve attached thereto. Hence, the auxiliary D-valve indirectly controls the operation of the main D-valve and the motor piston. The auxiliary D-valve is so formed in relation to the auxiliary feed ports that the auxiliary D-valve does not completely block hydraulic fluid flow through either one of the auxiliary feed ports at any position along its line of motion, thereby preventing hydraulic lock. Hydraulic lock would occur if the valve-actuating piston were compelled by its linkage connection with the motor piston to move against incompressible hydraulic fluid confined within a closed end bore by the complete closure of its auxiliary feed port by the auxiliary D-valve.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
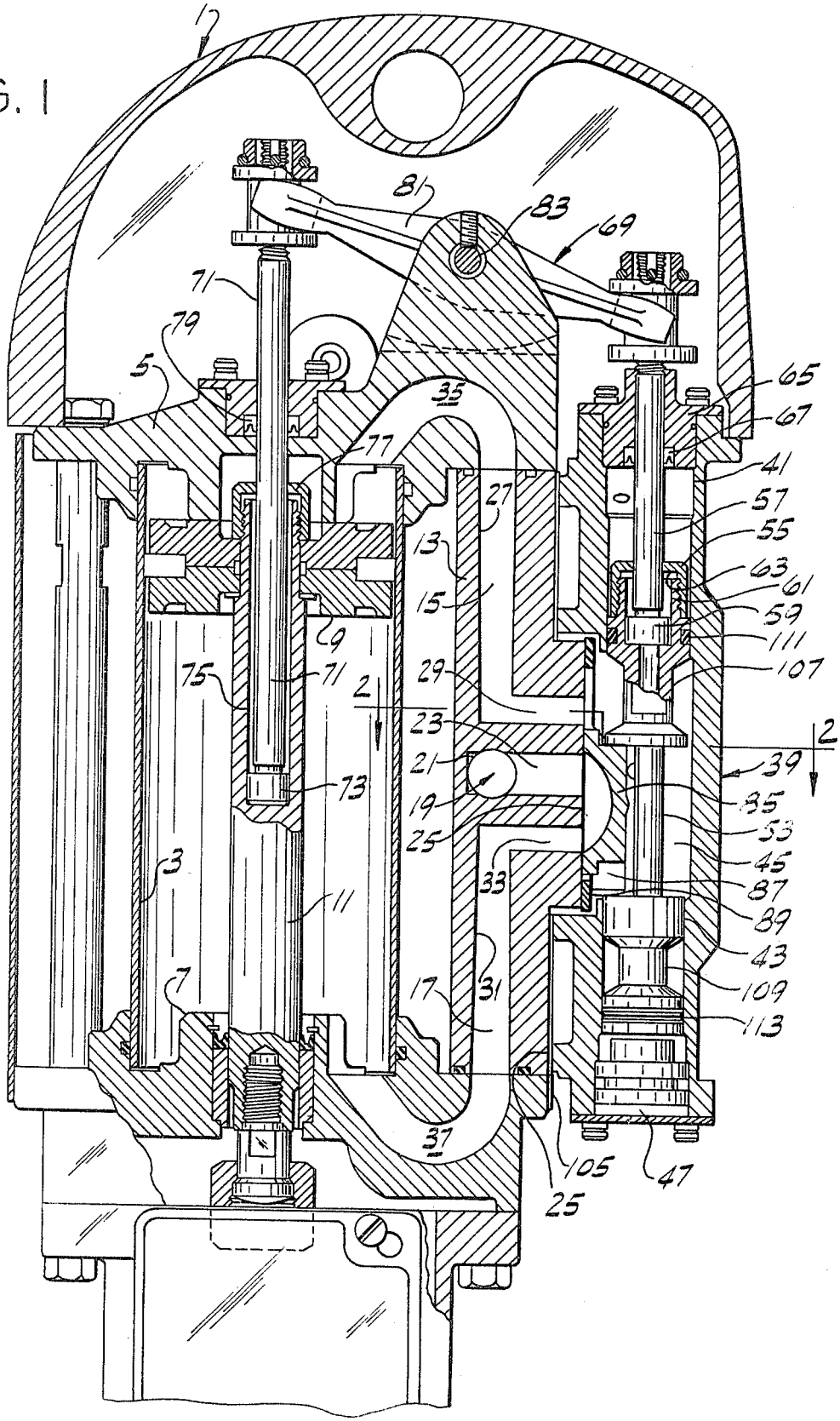
FIG. 1 is a longitudinal section of a hydraulic motor having a valve mechanism of this invention.

Referring to the drawings, there is generally indicated at 1 an expansible chamber motor, more particularly a hydraulic motor, provided with a valve mechanism of this invention. The motor comprises a cylinder 3 (shown in vertical position) having upper and lower end heads 5 and 7. A piston 9 reciprocates in the cylinder. The piston is fixed on the upper end of a piston rod 11 which extends through the lower head 7 as shown in FIG. 1 and which is utilized to drive a lubricant pump, such as a so-called lance-type pump (not shown). On one side, the motor has a lengthwise block 13. In this block are feed passages 15 and 17 and an exhaust passage 19 (see FIG. 1). The exhaust passage is formed by a hole 21 bored completely transversely across the block 13 centrally of the length of the block and by a main central exhaust port 23 bored in from an outer valve face 25 of the block to an intersection with the transverse hole 21. The feed passage 15 is formed by a longitudinal hole 27 bored in from the upper end of the block to a point short of the hole 21 and by a main feed port 29 bored in from the valve face 25 to an intersection with the lower end of hole 27. The feed passage 17 is formed by a longitudinal hole 31 bored in from the lower end of the block to a point short of the hole 21 and by a main feed port 33 bored in from the valve face 25 to an intersection with the upper end of hole 31. Holes 27 and 31 open into recesses 35 and 37 in the upper and lower end heads 5 and 7, respectively.

Figure 2:
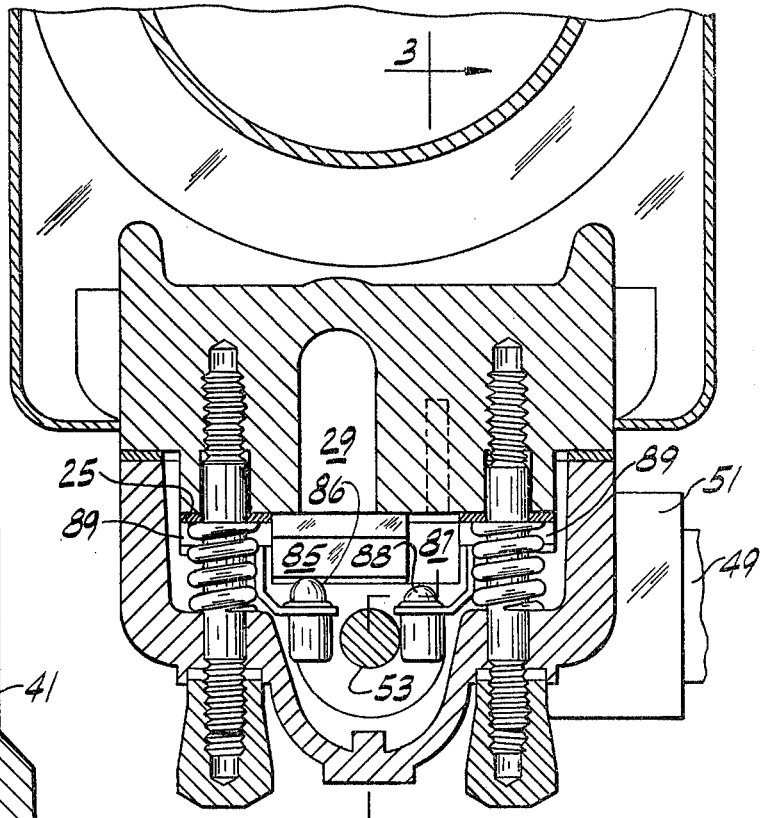
FIG. 2 is a section taken on line 2—2 of FIG. 1, showing the top of the main and auxiliary D-valves.

The block 13 can be formed of a single piece of metal (see FIG. 1). Alternatively, the block can be formed of two or more pieces connected together in sealed relation (not shown) so that the valve face 25 can be replaced when worn or damaged and so that passaging in the block can be economically produced by short-hole drilling. On the valve face 25 is fixed a valve chest 39 for containing pressurized hydraulic fluid for operating the motor. The chest comprises an elongated block of generally rectangular cross section somewhat longer than the block 13. In the upper and lower ends of the chest are longitudinal cylindrical bores 41 and 43, respectively, open to an enlarged central pressure chamber 45. The outer end of the bore 43 (its lower end) is closed against escape of pressurized hydraulic fluid by a plug 47. Pressurized fluid is supplied to the pressure chamber 45 through a side inlet 49 in a side boss 51 on the chest (see FIG. 2). An elongate cylindrical double-ended piston 53 reciprocates in the chest lengthwise of the motor cylinder, being slidable at its ends in the bores 41 and 43 between the limiting end positions in each of which its ends remain in sealing relation in the bores. Threaded on the upper end of the piston 53 is a cap 55 providing a lost-motion connection between the lower end of a piston-actuating rod 57 and the piston 53. The rod 57 has a head 59 at its lower end slidable in a bore 61 in the piston 53. The rod extends out of the cap 55 through an opening smaller than the bore 61 and the head 59 is engageable with the upper end 63 of cap 55 for lifting the piston. The rod 57 extends out of the upper end of the chest through an opening in an end closure 65 for the bore 41. A seal for the rod 57 in the end closure 65 is indicated at 67.

The rod 57 is a part of a linkage, generally indicated at 69, for operating the piston 53 from the motor piston 9. This linkage 69 includes a rod 71 having an enlarged head 73 at its lower end slidable in a bore 75 in the upper end of the motor piston rod 11. A cap 77 threaded on the upper end of the piston rod 11 above the piston 9 holds the piston 9 on piston rod 11 and has an opening for passage of the rod 71 but not of the head 73 to provide a lost-motion connection between the rod 71 and the piston rod 11. The rod 71 extends out of the motor cylinder through an opening in the upper end head 5. A seal for the rod 71 is shown at 79. The upper end of the rod 71 is coupled to one end of a rocker 81 pivoted at 83 on end head 5. The upper end of rod 57 is coupled to the other end of the rocker. This arrangement is such that near the end of a downstroke of the motor piston 9, cap 77 engages the head 73 on rod 71, pulls rod 71 down, rocks the rocker 81 counterclockwise as viewed in FIG. 1, pulls up the rod 57, and thus pulls the piston 53 up from the lowered position shown in FIGS. 1 and 3. Near the end of an upstroke of the piston 9, the bottom of the bore 75 engages the head 73 on rod 71, pushes the rod 71 up, rocks the rocker 81 clockwise, pushes down the rod 57, and thus pushes the piston 53 down from the fully raised position.

The piston 53 controls a main distributing valve 85, specifically a slide valve of D-form, for controlling the supply and exhaust of pressurized hydraulic fluid to and from the opposite ends of the motor cylinder, and also controls an auxiliary distributing valve 87, also a slide valve of D-form, located side-by-side with respect to the main D-valve 85, for in turn controlling the supply and exhaust of pressurized hydraulic fluid to and from the outer ends of the bores 41 and 43 in the valve chest 39. In that side of the valve chest which is secured against the valve face 25 is a valve-accommodating plate 89 with an opening in which the two D-valves 85 and 87 are slideable lengthwise of the motor cylinder in engagement with the valve face 25. The main D-valve 85, is relatively short and wide as compared to the auxiliary D-valve 87, the latter being relatively long and narrow (see FIGS. 1 and 2). The opening in plate 89 has a relatively short wide portion accommodating the sliding of the main D-valve 85 and a longer narrow portion accommodating the sliding of the auxiliary D-valve 87. The two D-valves are guided by the sides of the plate defining the opening and are maintained in engagement with the valve face 25 by means of balls 86 and 88 which are spring biased toward the valve face 25, and by the pressurized hydraulic fluid in chamber 45. The piston 53 has an annular recess 91 slightly longer than the length of the auxiliary D-valve 87. This recess receives the auxiliary D-valve in a lost-motion relation, and receives the shorter main D-valve 85 with a relatively larger degree of lost motion.

Extending into the block 13 from the valve face 25 along the line of motion of the main D-valve 85 are the main central exhaust port 23, the upper main feed port 29 and the lower main feed port 33. A passage (not shown) in the block 13 connects the port 23 to an auxiliary central exhaust port 92 extending into the block from the valve face 25 and located in the line of motion of the auxiliary D-valve 87. The block further has an auxiliary feed port 93 above the port 92 and a passage 95 leading from port 93 to a port 97 in the valve chest 39 at the upper end of bore 41 above the piston 53 and auxiliary feed port 99 below the port 92 and a passage 101 leading from port 99 to a port 103 in the valve chest at the lower end of bore 43 below the piston 53 (see FIG. 3). Gasket 105 between the valve chest 39 and the valve face 25 has apertures therein for the flow of hydraulic fluid to ports 97 and 103.

The piston 53 has upper and lower annular grooves 107 and 109, respectively. The upper grove 107 provides for communication from the pressure chamber 45 via port 29 to the feed passage 15 when the piston 53 is in its lowermost position (see FIG. 1). The lower groove 109 provides for communication from the pressure chamber 45 via port 33 to the feed passage 17 when the piston 53 is in its uppermost position. In an annular groove adjacent the upper end of the piston 53 is a packing ring 111, and in an annular groove adjacent the lower end of the piston 53 is a packing ring 113.

Figure 4:
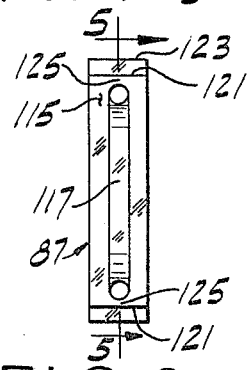
FIG. 4 is a view of the surface of the auxiliary D-valve toward the block on a line normal to the surface.
Figure 5:
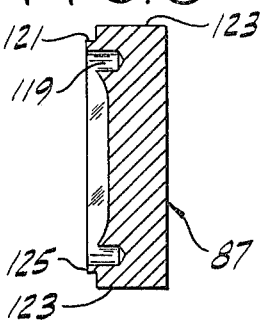
FIG. 5 is a section taken on line 5—5 of FIG. 4.
Figure 6:
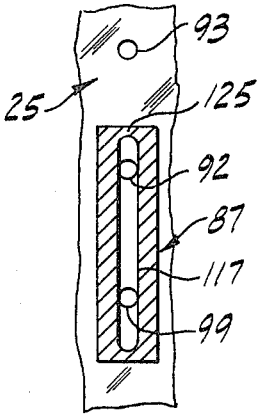
FIG. 6 is a section taken on line 6—6 of FIG. 3, showing the auxiliary D-valve in its down position.
Figure 7:
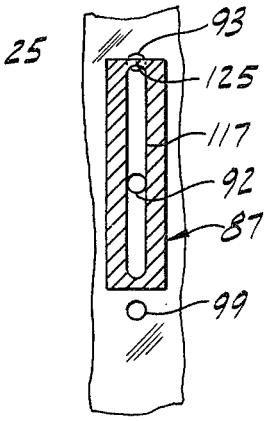
FIG. 7 is a section similar to FIG. 6 showing the auxiliary D-valve moved upward toward its upper position.

The auxiliary D-valve 87 engages the valve face 25 in sliding sealing relation. The engaging surface 115 of the auxiliary D-valve is of a generally rectangular shape when viewed in a direction normal to the surface as shown in FIG. 4. A recess 117 extends into the D-valve 87 from surface 115. This recess 117 and the valve face 25 define a passage for the flow of fluid between ports 99 and 92 when the D-valve 87 is in the lower position (see FIGS. 3 and 6) and between ports 93 and 92 when the D-valve is in the upper position. The recess 117 is of a generally elongate rectangular shape with rounded corners, as shown in FIGS. 4, 6 and 7, and the ends of the recess are defined by blind end holes 119 that extend into the auxiliary D-valve (see FIG. 5). These holes are closely spaced from notched or offset edges 121 that are spaced from end surfaces 123 of the D-valve 87 so that the surface 115 in effect forms a land on one side of the D-valve. Relatively narrow portions 125 of the flat surface 115 extend between holes 119 and notched edges 121. The dimension of each narrow portion 125 along the major axis of the D-valve 87 is less than the dimension of the auxiliary feed ports 93 and 99 along the line of motion of the auxiliary D-valve 87 (see FIGS. 6 and 7). Thus, the surface 115 and recess 117 are so formed in relation to the auxiliary feed ports that the auxiliary D-valve 87 does not completely block hydraulic fluid flow through either one of the auxiliary feed ports at any position along the line of motion of the auxiliary D-valve thereby preventing "hydraulic lock." "Hydraulic lock" would occur if the auxiliary feed ports were completely blocked by the auxiliary D-valve so that incompressible hydraulic fluid would be confined by the closed end of a bore of the valve chest 39 and by the valve-actuating piston 53 which is compelled to move thereagainst by the motor piston 9 acting through linkage 69 and rod 57. "Hydraulic lock" would stop the operation of the valve mechanism and, likely, would cause the mechanical failure of one or more structural elements of the valve mechanism.

Figure 3:
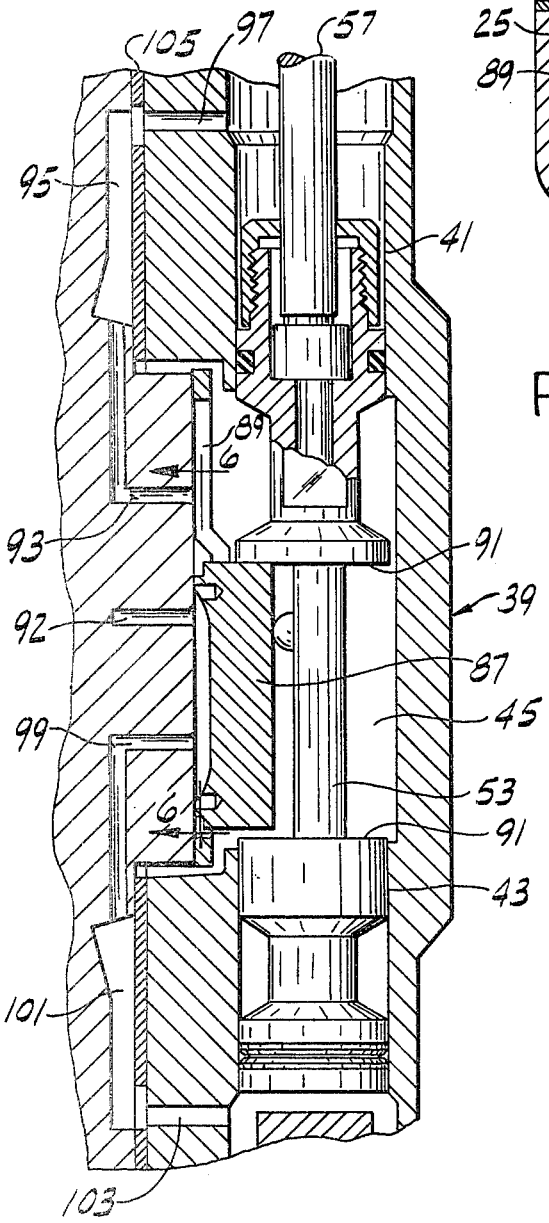
FIG. 3 is a section taken on line 3—3 of FIG. 2.

The operation of the valve mechanism and motor is as follows:

Assuming that the motor piston 9 is starting a downstroke, the parts will be in the position shown in FIGS. 1, 3 and 6. The piston 53 is in its lowermost position, there being some space between its lower end and the plug 47 in this position. The main D-valve 85 occupies its lowermost position of FIG. 1 wherein it establishes communication from the pressure chamber 45 via port 29 in the block 13 to the feed passage 15 to supply pressurized hydraulic fluid from the chamber to the motor cylinder above the motor piston 9 and wherein it establishes communication from the feed passage 17 via port 33 in the block 13 to the exhaust port 23, thereby venting the motor cylinder below the piston 9. In this position of the main D-valve, it is engaged against the upper end of the annular recess 91 in the piston 53. The auxiliary D-valve 87 occupies the position shown in FIG. 3 wherein it establishes communication from the pressure chamber 45 via port 93, passage 95 and port 97 to the upper end of the bore 41 to hold the piston down, and wherein it establishes communication from the lower end of bore 43 via port 103, passage 101, port 99 and port 92 in the block to the exhaust passage 19 thereby to vent the bore 43 below the piston 53.

As the motor piston 9 reaches the lower end of its stroke, the cap 77 engages the head 73 on rod 71 and pulls rod 71 down, thereby rocking the rocker 81 counterclockwise and pulling up rod 57 and the piston 53. As the piston 53 moves upward, the auxiliary D-valve 87 is moved upward but the main D-valve 85 remains in its lowermost position, by reason of its lost-motion arrangement in the annular recess 91, until the piston has moved upward to an intermediate position where the radial surface at the lower end of the annular recess 91 first engages main D-valve 85. This lost motion permits the motor piston 9 to complete its downstroke. As the piston 53 moves somewhat farther upward from the intermediate position, the auxiliary D-valve 87 reaches a position wherein it establishes communication from the pressure chamber 45 via port 99 (see FIG. 7), passage 101 and port 103 to the bore 43 below the lower end of piston 53, and wherein it establishes communication from the upper end of bore 41 via port 97, passage 95, port 93, port 92, and exhaust passage 19, thereby to vent the bore 41 above the piston. The result of this is that piston 53 is snapped upward by pressure in the bore 45 below the lower end of the piston to its raised position. This snap movement of the piston 53 to its raised position by pressure independently of the mechanical linkage is permitted by the lost-motion connection between the rod 57 and the piston 53. "Hydraulic lock" is prevented during the upward movement of piston 53 by reason of the surface 115 and recess 117 of the auxiliary D-valve 87 being so formed in relation to the auxiliary feed ports 93 and 99 that the auxiliary D-valve 87 does not completely block hydraulic fluid flow through either one of the auxiliary feed ports at any position of the piston 53.

As the piston 53 snaps upward, the main D-valve 85 is snapped upward to its raised position wherein it establishes communication from the pressure chamber 45 via port 33 in the block 13 to the feed passage 17 to supply pressure fluid from the chamber 45 to the motor cylinder below the motor piston 9, and wherein it establishes communication from the feed passage 15 via ports 29 and 23 in the block to the exhaust passage 19, thereby venting the motor cylinder above the motor piston. Thus, the motion of the motor piston is reversed and it starts its upstroke, with a quick cutoff by reason of the snap action of the piston 53 and the main D-valve. During the upstroke of piston 9, the rod 71 remains in a down position, and the lost-motion connection between the rod 71 and the piston rod 11 allows for the motion of piston 9 independently of the rod 71.

In the raised position of the piston 53, the auxiliary D-valve 87 occupies a raised position wherein it maintains the supply of pressure to the bore 43 below the lower end of the piston and vents the bore 41 above the piston thereby to maintain the piston in raised position. As the motor piston 9 reaches the upper end of its stroke, the bottom of bore 75 engages the head 73 on rod 71, pushes the rod 71 up, rocks the rocker 81 clockwise, pushes down the rod 57, and thus pushes down the piston 53. As the piston 53 is thus pushed downward, the auxiliary D-valve 87 is moved downward but the main D-valve remains in its raised position by reason of its lost-motion arrangement in the annular recess 91 until the piston 53 has moved downward to the point where the radial surface at the upper end of annular recess 91 engages the main D-valve. This lost motion permits the motor piston 9 to complete its upstroke. As the piston 53 moves somewhat farther downward, the auxiliary D-valve reaches a position wherein it establishes communication from the pressure chamber 45 via port 93, passage 95 and port 97 to the upper end of the bore 41 above the piston 53 and vents the bore 43 below the piston 53 via port 103, passage 101, port 99, port 92, and exhaust passage 19. The result of this is that the piston 53 is snapped down by pressure in bore 41 to its lowermost position shown in FIGS. 1 and 3. This downward snap movement of the piston 53 to its lowermost position by pressure independently of the mechanical linkage is permitted by the lost-motion connection between rod 57 and the piston 53. "Hydraulic lock" is prevented during the downward movement of piston 53 by the reason of the surface 115 and recess 117 of the auxiliary D-valve 87 being so formed in relation to the auxiliary feed ports 93 and 99 that the auxiliary D-valve 87 does not completely block hydraulic fluid flow through either one of the auxiliary feed ports at any position of the piston 53.

As the piston 53 snaps downward, the main D-valve is snapped downward to its lowermost position shown in FIG. 1 wherein it feeds pressurized fluid to the motor cylinder above motor piston 9 and vents the motor cylinder below piston 9 for the downstroke of piston 9. Again, the reversal is effected with a quick cutoff by reason of the snap action of the piston 53 and the main D-valve. The auxiliary D-valve is snapped to its lowered position, and the cycle is repeated.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Hydraulic valve mechanism for an expansible chamber hydraulic motor comprising a cylinder having therein a motor piston on a piston rod, said valve mechanism comprising a block having a valve face and an exhaust passage from a central main exhaust port in said face, and feed passages extending from main feed ports in said face on opposite sides of said exhaust port to the opposite ends of the cylinder, a valve chest secured in sealed relation overlying the face, said valve chest having aligned piston-receiving bores at its opposite ends with a chamber for pressurized hydraulic fluid between the bores, the outer ends of the bores being closed, a valve-actuating piston on a valve-actuating piston rod slidable at its ends in the bores, a main D-valve and an auxiliary D-valve connected with the valve-actuating piston slidable on said face within the valve chest, said block having a central auxiliary exhaust port and auxiliary feed ports in said face with said auxiliary feed ports in the line of motion of the auxiliary D-valve on opposite sides of the auxiliary exhaust port, said block further including passages connecting the auxiliary feed ports and the ends of said bores, and means connecting the motor piston rod with the valve-actuating piston rod, said auxiliary D-valve having a surface in sliding sealing engagement with said valve face and a recess in said surface for the flow of hydraulic fluid therethrough from either one of the auxiliary feed ports to the auxiliary exhaust port, said surface and recess being so formed in relation to the feed ports that the auxiliary D-valve does not completely block hydraulic fluid flow through either one of the auxiliary feed ports at any position along its line of motion, thereby preventing hydraulic lock.

2. A valve mechanism as set forth in claim 1 wherein said surface has narrow portions between the ends of the recess and the ends of said surface along the line of motion of the auxiliary D-valve, said narrow portions only partially covering the auxiliary feed ports at certain positions of the auxiliary D-valve along its line of motion while not completely covering either one of the auxiliary feed ports at any position of the auxiliary D-valve along its line of motion.

3. A valve mechanism as set forth in claim 2 wherein the dimension of the narrow portions along the line of motion of the auxiliary D-valve is less than the dimension of either one of the auxiliary feed ports in said face along the line of motion of the auxiliary D-valve.

4. A valve mechanism as set forth in claim 1 wherein said surface of the auxiliary D-valve when viewed in a direction normal thereto has a rectangular shape and said recess when so viewed has a generally elongate rectangular shape with rounded corners.

5. A valve mechanism as set forth in claim 4 wherein the auxiliary D-valve has some of its edges adjacent the face notched so that said surface of the auxiliary D-valve constitutes a land on one side of the auxiliary valve.

* * * * *